US006135728A

United States Patent [19]

Klein et al.

[11] Patent Number: 6,135,728

[45] Date of Patent: Oct. 24, 2000

[54] CENTRIFUGAL PUMP HAVING AN AXIAL THRUST BALANCING SYSTEM

[75] Inventors: Manfred P. Klein, Highland Park; Jeffrey S. Brown, Plainfield; Scott A. McAloon, Lombard; Peter E. Phelps, Darien, all of Ill.

[73] Assignee: Innovative Mag-Drive, L.L.C., Chicago, Ill.

[21] Appl. No.: 09/267,440

[22] Filed: Mar. 12, 1999

Related U.S. Application Data

[60] Provisional application No. 60/106,103, Oct. 29, 1998.

[51] Int. Cl.[7] ..... F04B 17/00

[52] U.S. Cl. ..... 417/420

[58] Field of Search ..... 417/420, 362, 417/365, 356; 415/104, 106, 112

[56] References Cited

U.S. PATENT DOCUMENTS

| | | | |
|---|---|---|---|
| 4,047,847 | 9/1977 | Oikawa | 417/370 |
| 4,226,574 | 10/1980 | Villette | 417/420 |
| 4,644,202 | 2/1987 | Kroy et al. | 310/58 |
| 4,793,777 | 12/1988 | Hauenstein | 417/365 |
| 4,867,633 | 9/1989 | Gravelle | 415/106 |
| 5,061,151 | 10/1991 | Steiger | 415/106 |
| 5,127,792 | 7/1992 | Katsuta et al. | 415/104 |
| 5,158,440 | 10/1992 | Cooper et al. | 417/423.1 |
| 5,201,642 | 4/1993 | Hinckley | 417/420 |
| 5,615,996 | 4/1997 | Suzuki et al. | 415/1 |
| 5,641,275 | 6/1997 | Klein et al. | 417/420 |

OTHER PUBLICATIONS

Karassik Krutzsch, Fraser, and Messina, *Pump Handbook*, 2nd. Ed., McGraw–Hill Book Company, pp. 2.53–2.59.

Robert Neumaier, *Hermetic Pumps*, Gulf Publishing, Houston, Texas, pp. 154–155; 356–359.

*Primary Examiner*—Teresa Walberg
*Assistant Examiner*—Vinod D Patel

[57] ABSTRACT

A centrifugal pump includes a housing having a housing cavity, an inlet, and an outlet. A shaft and a radial bearing in the housing cavity are rotatable with respect to one another. An impeller is positioned to receive a fluid from the inlet and to exhaust a fluid to the outlet. The impeller has an impeller recess terminating at an impeller hub with an opening therein. The impeller recess receives the radial bearing. A thrust balancing system includes a thrust balancing valve. The thrust balancing valve has a ring extending from the impeller hub. The ring has an interior region in fluidic communication with the opening. The ring and the shaft are adapted to define a variable-sized vent between the ring and the shaft to balance axial forces upon the impeller under various operating points of the pump and various specific gravities of the pumped fluid.

31 Claims, 6 Drawing Sheets

CENTRIFUGAL PUMP HAVING AN AXIAL THRUST BALANCING SYSTEM

This application claims the benefit of the filing date of U.S. provisional Application No. 60/106,103, filed on Oct. 29, 1998, from which the following specification, claims, and drawings were copied in their entirety without the addition of any new subject matter.

FIELD OF INVENTION

The present invention relates to a centrifugal pump having an axial thrust balancing system for balancing axial forces acting upon the impeller during operation of the pump.

BACKGROUND OF THE INVENTION

Centrifugal pumps include canned-motor centrifugal pumps and magnetic-drive centrifugal pumps. Magnetic-drive pumps are generally well-suited for pumping caustic and hazardous fluids because shaft seals are not required. Instead of shaft seals, magnetic-drive pumps generally feature a pump shaft separated from a drive shaft by a containment shell. The drive shaft is arranged to rotate with a first magnetic assembly, which is magnetically coupled to a second magnetic assembly. The second magnetic assembly applies torque to the pump shaft to pump a fluid contained by the containment shell.

A centrifugal pump often contains one or more product-lubricated bearings such as a radial bearing or an axial thrust bearing. Product-lubricated bearings refer to bearings that are lubricated by the pumped fluid. An axial thrust bearing typically includes a thrust ring which requires regular inspection and replacement to prevent unwanted down-time in manufacturing operations or other critical pumping requirements. The regular inspection and replacement of axial thrust bearings contributes to pump maintenance costs. Thus, a need exists for reducing the inspection and maintenance burdens associated with axial bearings.

An axial bearing, about an eye of an impeller, may wear rapidly in typical pumps which use a discharge-to-suction fluid path to lubricate the product-lubricated bearings. In a discharge-to-suction fluid path, fluid is heated from friction between stationary and moving bearing portions as fluid circulates through a radial bearing. Upon reaching the suction region, the heated fluid tends to vaporize because of the lower pressure present at the suction region than elsewhere in the pump. The axial bearing is exposed to a vapor phase of the fluid in the suction region. The vapor phase has virtually no lubricating properties and promotes radial bearing wear or failure, even if ameliorated by the intake of additional fluid at the pump inlet. As pump capacity and loads increase, the axial bearing, about the eye of the impeller, becomes even less reliable upon exposure to the vapor phase. Thus, a need exists for improving the reliability of axial bearings mounted about the impeller eye in product-lubricated pumps.

Product-lubricated bearings are subject to the condition and the very presence of pumped fluid for lubricating the bearings. The pumped fluid may contain air, gas, or mixtures of gas and liquid, which can damage the radial bearing and the axial bearing by providing inadequate lubrication and cooling. When the pumped fluid in a product-lubricated pump contains insufficient liquid or liquid flow to lubricate the radial bearing, the condition may be referred to as dry-running. Thus, a need exists for a pump having enhanced resistance to bearing failure during dry-running or similar conditions.

SUMMARY OF THE INVENTION

In accordance with a preferred embodiment of the invention, a centrifugal pump includes a housing having a housing cavity, an inlet, and an outlet. A shaft is located in the housing cavity. A radial bearing coaxially surrounds the shaft. The shaft and the radial bearing are rotatable with respect to one another. An impeller is positioned to receive a fluid from the inlet and to exhaust a fluid to the outlet. The impeller has an impeller recess terminating at an impeller hub with an opening therein. The impeller recess receives the radial bearing.

A thrust balancing system includes a thrust balancing valve. The thrust balancing valve has a ring extending from the impeller hub. The ring defines an interior region in fluidic communication with the opening. The ring and the shaft are adapted to define a variable-sized vent between the ring and the shaft. The pump preferably includes wear rings with axially extended rings which permit the thrust balancing system to operate at an axial position, within a range of axial positions, based upon the operating point of the pump and the specific gravity of the pumped fluid.

The thrust balancing system for balancing axial hydraulic thrust on an impeller reduces or eliminates maintenance of axial thrust bearings by generally maintaining spatial axial separation between members of any axial thrust bearing during normal pump operation. Moreover, the thrust balancing system increases mechanical efficiency and reduces torque driving requirements of the pump by eliminating or reducing friction associated with axial thrust bearings. In particular, the thrust balancing system may reduce the activity (i.e. duty cycle) of axial thrust bearings or eliminate the requirement for axial thrust bearings altogether. However, a conservative engineering approach would replace a conventional axial bearing with an auxiliary axial bearing intended for intermittent use in conjunction with the thrust balancing system.

Another aspect of the invention includes a radial bearing positioned in an impeller recess at or near the center of gravity of the pump upstream from the thrust balancing valve to improve resistance against dry-running and to prevent flashing of the pumped fluid. As used herein, upstream means that the radial bearing is located further toward the discharge pressure or direction of fluid flow than the thrust balancing valve. Yet another aspect of the invention includes a radial bearing preferably having a minimal diameter, determined based upon maximum load considerations for normal operation, to improve resistance against dry-running operation.

DETAILED DESCRIPTION OF THE PREFERRED EMBODIMENTS

Figure 1:
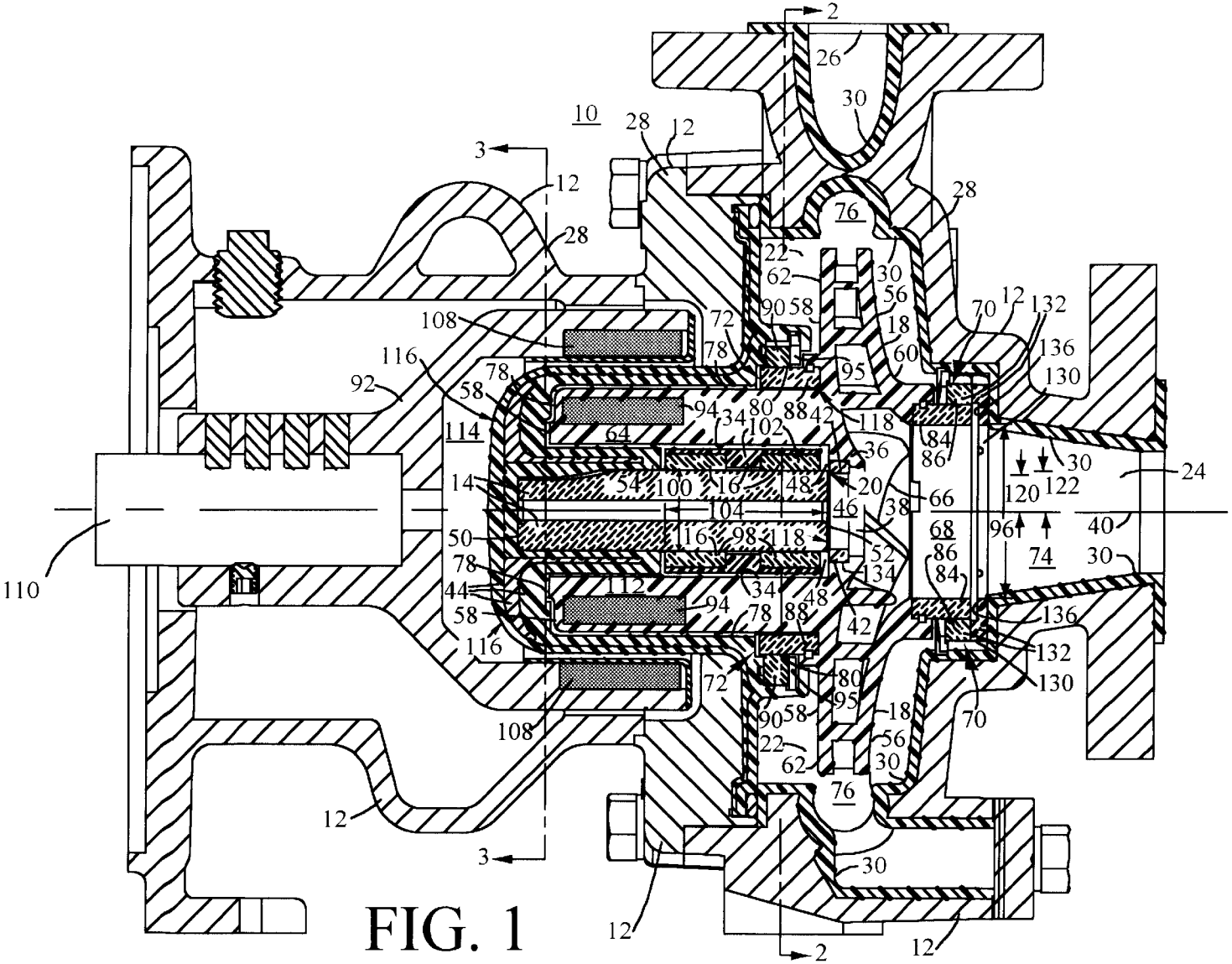
FIG. 1 is a cross-sectional view of a centrifugal magnetic-drive pump in accordance with the invention.

FIG. 1 illustrates a centrifugal pump 10 in accordance with the present invention. The centrifugal pump 10 includes a housing 12, a shaft 14, a radial bearing 16, an impeller 18, and a thrust balancing valve 20. The housing 12 has a housing cavity 22, an inlet 24, and an outlet 26. The housing 12 may be cast, molded, or otherwise formed by a group of housing sections 28 which can be attached to each other with fasteners. The housing cavity 22 is preferably lined with a corrosion-resistant material 30. A shaft 14 is located in the housing cavity 22. A radial bearing 16 coaxially surrounds the shaft 14. The shaft 14 and the radial bearing 16 are rotatable with respect to one another.

An impeller 18 is positioned to receive a fluid from the inlet 24 and to exhaust a fluid to the outlet 26 during rotation of the impeller 18. The impeller 18 has an impeller recess 34 terminating at an impeller hub 36 with an opening 38 in the impeller hub 36. The impeller recess 34 receives the radial bearing 16. The impeller hub 36 is preferably, generally axially located within the housing 12 such that a radial axis extending perpendicularly to a shaft axis 40 of the shaft 14 would bisect both the impeller hub 36 and the outlet 26 of the pump 10.

A thrust balancing valve 20 includes a ring 42 extending from or affixed to the impeller hub 36 and preferably spaced apart from a containment member 44. The ring 42 has an interior region 46 in fluidic communication with the opening 38. The ring 42 and the shaft 14 are adapted to define a thrust-balancing valve 20 having a variable-sized vent 48 between the ring 42 and the shaft 14. The variable-sized vent 48 adjusts to a vent size for regulating a flow of fluid through the variable-sized vent 48 to balance net axial forces acting upon the impeller 18 during operation of the pump 10. The thrust balancing valve 20 adjusts flow to hydraulically displace the impeller 18 to an axial position within a range of axial positions that minimizes any net axial force on the impeller 18.

The shaft 14 has a first end 50 and a second end 52. The first end 50 preferably mates with a socket 54 in a containment member 44 or is otherwise mechanically supported by the containment member 44. The second end 52 forms a boundary of the variable-sized vent 48 and a stop for rearward axial movement of the impeller 18. The first end 50 and the second end 52 may be planar or curved. The second end 52 is preferably planar and normal to the shaft axis 40. Alternately, the second end 52 may be rotationally symmetric (i.e. generally conical), with reference to the shaft axis 40, to act as one side of a thrust balancing valve.

The shaft 14 is preferably hollow and slidably removable from the containment member 44. The shaft 14 is hollow to reduce or eliminate the tendency of hydraulic forces to pull the shaft 14 out from the socket 54 in the containment member 44. In alternate embodiments, the shaft 14 is not hollow, but threaded, notched, molded, adhesively bonded, or otherwise mechanically attached to the containment member 44.

As shown in FIG. 1, the shaft 14 comprises a cantilevered shaft that advantageously leaves the inlet 24 available for mounting flow-enhancing equipment for pumping difficult fluids, liquids, gases, or mixtures of gases and fluids under difficult conditions, such as low or intermittently low pressures. The cantilevered shaft 14 with the unobstructed inlet 24 to the pump allows the best NPSH (Net Positive Suction Head) characteristics for feeding the pump so that gas prone to cavitation and low pressure fluids can successfully feed the pump.

The shaft 14 is preferably composed of a ceramic material or a ceramic composite. In an alternate embodiment, the shaft 14 is composed of a stainless steel alloy or another alloy with comparable or superior corrosion-resistance and structural properties. In another alternate embodiment, the shaft comprises a metal base coated with a ceramic coating or another hard surface treatment.

The impeller 18 preferably comprises a closed impeller, although in other embodiments open impellers or partially closed impellers may be used. The impeller 18 preferably includes a front side 56 facing an inlet 24 and a back side 58 opposite the front side 56. For a closed impeller 18 as shown in FIG. 1, the front side 56 may be a generally annular and curved surface terminating in a flange 60. The back side 58 may include a generally cylindrical portion 64 and a generally annular surface 62 extending radially outward from the cylindrical portion 64. The impeller 18 includes blades 66 for propelling a fluid from an eye 68 of the impeller 18 generally radially outward during rotation of the impeller 18.

A first wear ring assembly 70 is associated with the front side 56 and a second wear ring assembly 72 is associated with the back side 58 of the impeller 18. The first wear ring assembly 70 defines a boundary between a suction chamber 74 and a discharge chamber 76.

The second wear ring assembly 72 defines a boundary between a discharge chamber 76 and a balancing chamber 78. The second wear ring assembly 72 preferably provides hydrodynamic resistance to fluid at discharge pressure so that fluid traversing a gap 80 or labyrinth of the second wear ring from the discharge chamber 76 to the balancing chamber 78 is reduced in pressure to approximate or equal a balancing pressure suitable for balancing axial thrust acting upon the impeller 18.

Alternately, in another preferred embodiment, the second wear ring assembly 72 reduces the pressure to an intermediate pressure suitable for subsequent increases in pressure and pressure uniformity throughout the balancing chamber 78 by radial ribs 82 extending from the containment member 44. After the fluid at the intermediate pressure interacts with the radial ribs 82, a balancing pressure, in the balancing chamber 78, suitable for balancing axial thrust upon the impeller 18 is obtained. The balancing pressure is preferably within a range from approximately one-quarter of the total dynamic head (TDH) of the discharge chamber 76 to approximately one-third of the total dynamic head (TDH) of the discharge chamber 76.

The first wear ring assembly 70 preferably includes a first inner ring 84 affixed to the impeller 18 at a flange 60 and cooperating with a first outer ring 86. The first inner ring 84 rotates with the impeller 18, while the first outer ring 86 is generally stationary in the rotational direction of the first inner ring 84. The first inner ring 84 is preferably axially elongated to have a greater axial length than the first outer ring 86. The first wear ring assembly 70 allows operation of the impeller 18 within a range of potential axial positions of the impeller 18 relative to the housing 12. The first outer ring 86 is affixed to the housing cavity 22 or a thrust pad 130. The first outer ring 86 preferably has a maximum wearing surface area less than a wearing surface area of the first inner ring 84. While the first inner ring 84 is preferably axially longer than the first outer ring 86, in alternate embodiments the first inner ring and the first outer ring may have any relative axial lengths with respect to one another.

The second wear ring assembly 72 includes a second inner ring 88 affixed to or on the impeller 18 and a second outer ring 90 operably connected to a containment member 44 or the housing cavity 22. The second inner ring 88 rotates with the impeller 18, while the second outer ring 90 does not. The second inner ring 88 preferably has a greater axial length than the second outer ring 90. The second wear ring assembly 72 allows operation of the impeller 18 within a range of potential axial positions of the impeller 18 relative to the housing 12. The second outer ring 90 preferably has a maximum wearing surface area less than a wearing surface area of the second inner ring 88. While the second inner ring 88 is preferably axially longer than the second outer ring 90, in alternate embodiments the second inner ring and the first second ring may have any relative axial lengths with respect to one another.

The first wear ring assembly 70 preferably has a smaller inner diameter than the second wear ring assembly 72 does. In particular, a first generally circular area within the first inner ring 84 is less than or equal to approximately seventy percent of a second generally circular area within the second inner ring 88. The first generally circular area is bounded by an inner circumference of the first inner ring 84 of the first wear ring assembly 70. The second generally circular area is bounded by an inner circumference of the second inner ring 88 of the second wear ring assembly 72.

Figure 4:
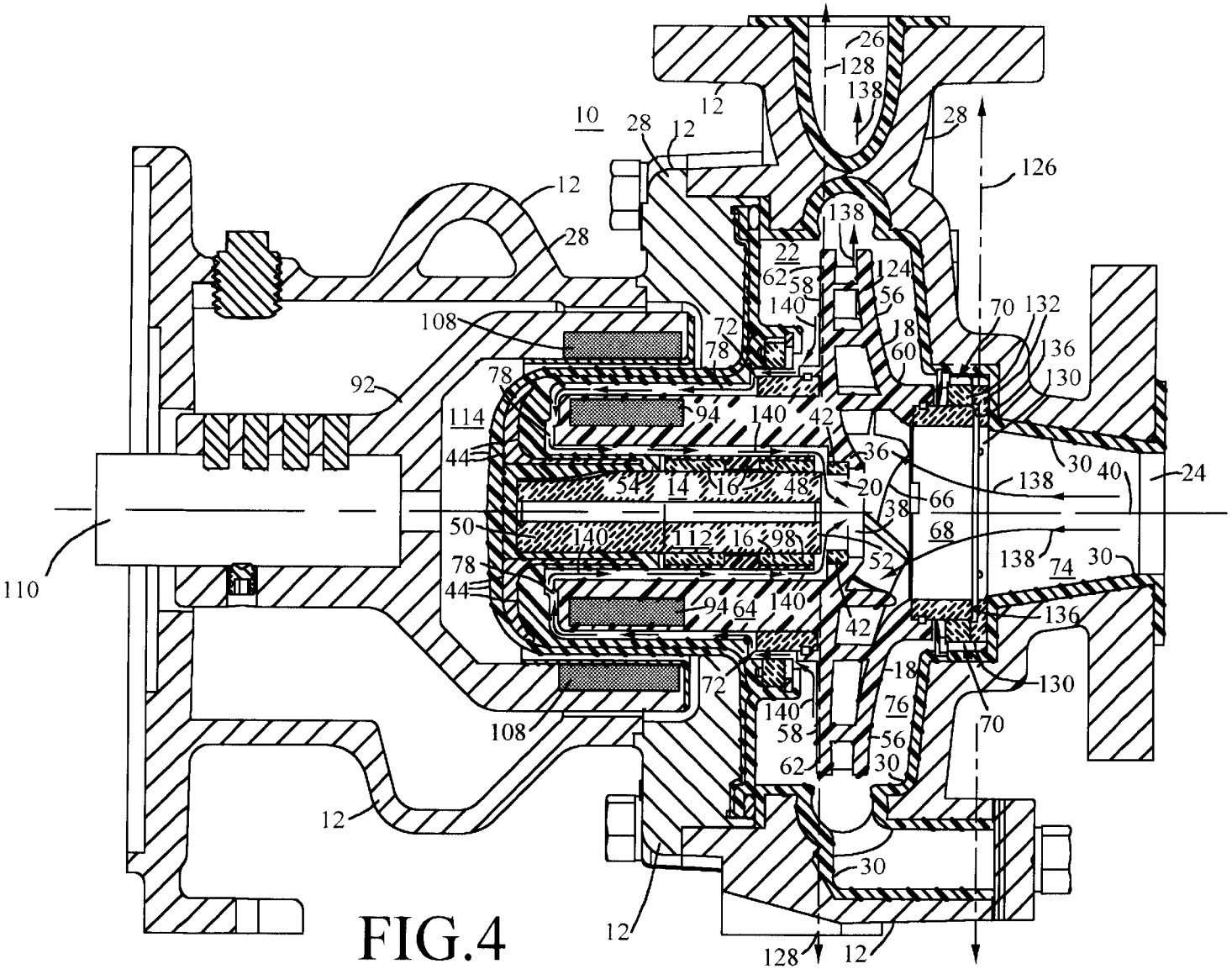
FIG. 4 is a cross-sectional view of a pump of FIG. 1 operating at an intermediate axial position within a range of potential axial positions of the impeller to balance axial forces on the impeller.

The first generally circular area is associated with a suction force acting upon the impeller 18, while the second generally circular area is associated with a reduced discharge force, called the balancing force, acting upon the impeller 18. The area ratio or percentage of the first generally circular area to the second generally circular area is selected such that the balancing valve 20 is capable of adjusting the balancing force to balance front-side impeller forces against the back-side impeller forces. The front-side impeller forces are represented by the sum of the discharge force and suction force acting on a front side 56 of the impeller 18. The back-side impeller forces are represented by the sum of the balancing force and the discharge force acting upon the back side 58 of the impeller 18. A back-side discharge force acting upon the annular surface 62 of the back side 58 of the impeller 18 opposes a front-side discharge force acting upon the curved annular surface of the front side 56 of the impeller 18. The balancing valve 20 can adjust the balancing force over a range limited by the area ratio, impeller geometry, and pump internal geometry, among other factors. In practice, the area ratio is tested by verifying stable operation of the thrust balancing system 118 during which an axial position of the impeller 18 ideally remains in an intermediate position without contacting a first limit 126 (FIG. 4) or a second limit 128 (FIG. 4).

The second wear ring assembly 72 forms a filter for blocking all or most particles in the pumped fluid which are larger than the wear ring gap 80 or clearance between the second inner ring 88 and the second outer ring 90. Particles or contaminates in the discharge chamber 76 are prevented from entering the balancing chamber 78 in accordance with the filtering properties of the second wear ring assembly 72. The second wear ring assembly 72 protects the containment member 44, the cylindrical portion 64 of the impeller 18, and the first magnet assembly 94 from particles which would otherwise cause damage. Thus, the pump 10 is capable of pumping particle laden fluids.

The first outer ring 86 is preferably resiliently biased axially frontward or toward the inlet 24. The second outer ring 90 is preferably resilient biased backwards or toward the dry-end 114. The first outer ring 86 and the second outer ring 90 are radially retained by friction such that the radial bearing 16 primarily supports radial loads acting on the impeller 18. The radial bearing 16 optimally supports all radial forces acting on the impeller 18 during normal operation of the pump 10. Axially biasing of the first outer ring 86 and the second outer ring 90 retains the outer rings to allow ready removal of the impeller 18 from the pump 10 for servicing. Conversely, axial biasing of the outer rings simplifies assembly or reassembly of the impeller 18 within the pump. The first outer ring 86 and the second outer ring 90 are preferably biased by corrosion-resistant springs 95 such as coil springs, leaf springs, spiral springs, or the like. The springs 95 may be encapsulated in an elastomer or coated with an elastomer to improve corrosion-resistance.

The first inner ring 84, the second inner ring 88, the first outer ring 86, and the second outer ring 90 are preferably composed of ceramic material because ceramic materials tend to hold their tolerances over their lifetime. In addition, smaller tolerances and clearances are possible with ceramic wear rings than for many metals, alloys, polymers, plastics, or other materials.

The impeller 18 has an impeller inlet diameter 96 and cylindrical portion diameter of the cylindrical portion 64. The radial bearing 16 preferably has a bearing diameter 100 that is less than both the impeller inlet diameter 96 and the cylindrical portion diameter. Here in a preferred embodiment, the bearing diameter 100 represents a diameter at an interface between the moving radial bearing 16 and the stationary shaft 14. The bearing diameter 100, and consequently the bearing surface area, is preferably minimized to a minimum bearing diameter to enhance dry-run performance, through the reduction of the sliding velocity at the interface of the radial bearing 16. The minimum bearing diameter, and consequently the minimum bearing surface area, is great enough to handle a highest anticipated radial load during normal operation of the pump.

In a preferred embodiment, the radial bearing 16 comprises a carbon bushing 98 having a minimum bearing diameter minimized to an extent to permit dry-running of the pump for a continuous period of at least one half hour. Depending upon the highest anticipated radial load among other factors, a carbon bushing 98 having a suitable diameter and construction may permit dry-running for as long as one hour or more.

In another preferred embodiment, the radial bearing comprises a ceramic bushing and has a minimum bearing diameter minimized to an extent to permit dry-running of the pump for a continuous period of at least five minutes. Depending upon the highest anticipated radial load among other factors, a ceramic bushing may permit dry-running for as long as fifteen minutes or more. Silicon carbide is preferred for the ceramic bushing, although in alternate embodiments other ceramic materials may be used. Although a ceramic bushing or carbon bushing 98 is preferably housed in a bearing retainer 102 to form the radial bearing 16, in alternate embodiments, ceramic pads or carbon pads may be housed in a bearing retainer 102 to form an alternate radial bearing.

The radial bearing 16 is disposed within an impeller recess 34 such that the radial bearing 16 extends or spans over a predetermined axial region 104 of the shaft 14. The predetermined axial region 104 is located near or at a center of gravity of the impeller 18 and near or at a center of external radial forces acting upon the impeller 18. To extend over the predetermined axial region 104, which optimally includes both the center of gravity and a center of external radial forces, the radial bearing 16 may comprise multiple bushings or pads.

Positioning the radial bearing 16 at the center of external radial forces acting upon the impeller 18 improves the radial load handling of the radial bearing 16 during the normal pumping of a liquid; especially where the radial bearing 16 is well-lubricated by the pumped liquid. The main external forces acting upon the impeller 18 during the normal pumping of a liquid are generally uneven forces from hydrodynamic interactions between the impeller 18 and a housing cavity 22 of the pump. In contrast, the main forces during dry-running of the pump tend to be the weight of the impeller 18 and any weight imbalance in the impeller 18. Positioning the radial bearing 16 at the center of gravity of the impeller 18 minimizes friction and increases resistance against dry-running damage which may otherwise occur to the radial bearing 16.

Figure 2:
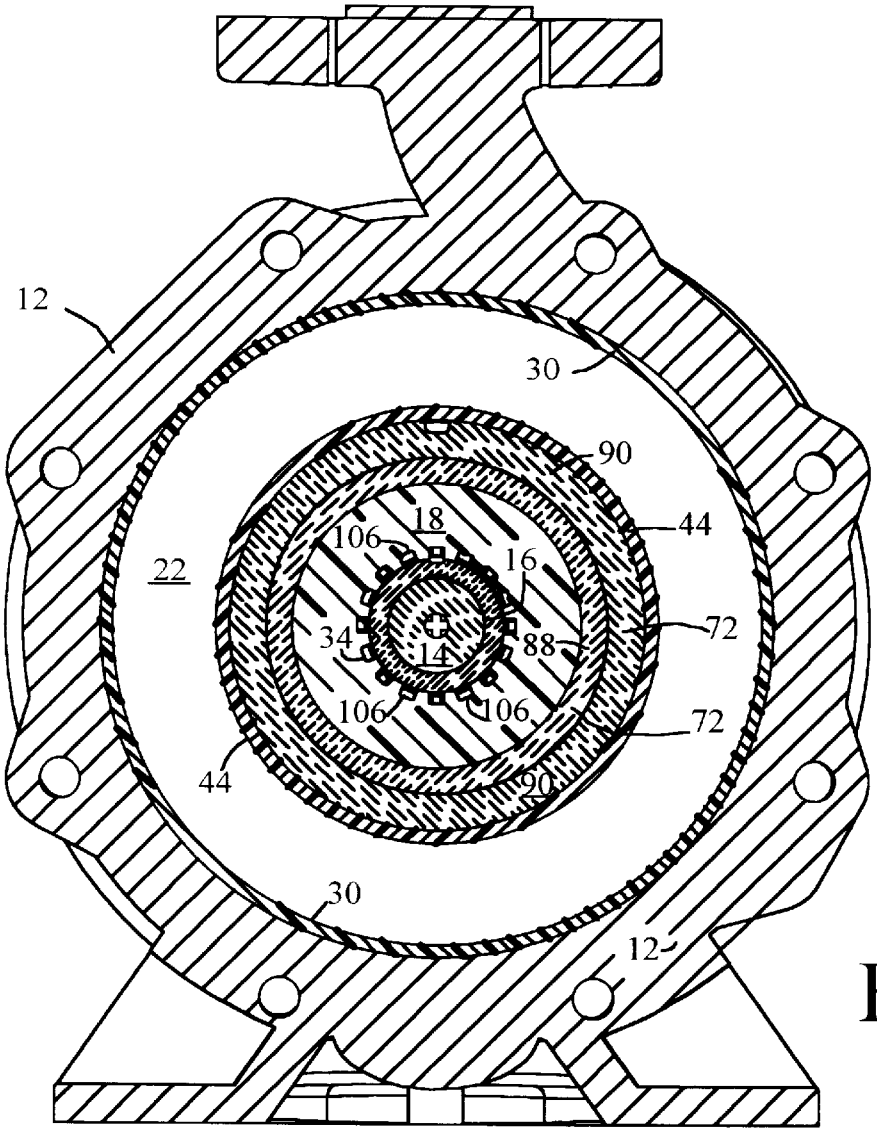
FIG. 2 is a cross-sectional view of the pump as viewed along reference line 2—2 of FIG. 1.

The radial bearing 16 is mated, interlocked, or otherwise mechanically joined with the impeller recess 34 to preferably define a series of spline-like openings 106 between the impeller recess 34 and the radial bearing 16, as best illustrated in FIG. 2. The impeller recess 34, the radial bearing exterior, or both may contain axial channels to form the spline-like openings 106. The spline-like openings 106 allow pumped fluid to travel from the second wear ring assembly 72, around a back side 58 of the impeller 18, through the vent 48 and back to the suction chamber 74. The fluid flows around the radial bearing 16 to provide cooling and lubrication for the radial bearing 16 which promotes pump longevity.

A first magnet assembly 94 is preferably associated with the impeller 18 such that the first magnet assembly 94 and the impeller 18 rotate simultaneously. The first magnet assembly 94 may be integrated into the impeller 18 as shown in FIG. 1. A second magnet assembly 108 is preferably coaxially oriented with respect to the first magnet assembly 94. The second magnet assembly 108 permits coupling to a drive shaft 110 through a containment member 44. The second magnet assembly 108 is carried by a rotor 92. A drive motor 93 is capable of rotating the drive shaft 110 and the rotor 92.

The containment member 44 is oriented between the first magnet assembly 94 and the second magnet assembly 108. The containment member 44 of the pump is sealed to the housing 12 for containing the pumped fluid to a wet-end 112 of the pump and isolating the pumped fluid from a dry-end 114 of the pump.

The containment member 44 is preferably made from a dielectric. For example, the containment member 44 is preferably composed of a reinforcedpolymer, a reinforcedplastic, a plastic composite, a polymer composite, a ceramic, a ceramic composite, a reinforced ceramic or the like. Multiple dielectric layers 116 may be used to add structural strength to the containment member 44 as illustrated in FIG. 1. Notwithstanding the foregoing composition of the containment member 44, alternate embodiments may use metallic fibers to reinforce the dielectric, a metallic containment shell instead of a dielectric one, or a single layer of dielectric instead of multiple layers.

The thrust balancing system 118 includes a thrust balancing valve 20 acting in cooperation with the second wear ring assembly 72, the radial ribs 82 of the containment member 44, the spline-like openings 106, and an impeller back side 58. The impeller back side 58 has an impeller back surface area including surfaces associated with the cylindrical portion 64 along with the impeller recess 34.

The thrust balancing valve 20 is preferably arranged so that the inner radius 120 of the ring 42 is less than a shaft radius 122 of the second end 52 of the shaft 14. Accordingly, the balancing valve 20 may close as the ring 42 contacts the second end 52 of the shaft 14. The impeller hub 36 preferably has an annular recess 134 for receiving the ring 42 and an opening 38 adjoining the annular recess 134. The opening 38 is preferably generally cylindrical and coextensive with an interior of the ring 42 to form an unrestricted flow path through the vent 48 to the suction chamber 74. The vent 48 preferably ranges in vent size from twenty to thirty thousands, although in alternate embodiments other vent sizes and ranges are possible and fall within the scope of the invention. The vent size represents any gap between the shaft 14 and the ring 42 capable of supporting fluid flow to the suction chamber 74 when the thrust balancing valve 20 is open.

The thrust balancing system 118 for balancing thrust on the impeller 18 uses a discharge chamber 76, a suction chamber 74, and a balancing chamber 78. The suction chamber 74 is in fluidic communication with the inlet 24 and is bounded by the first wear ring assembly 70 and the thrust-balancing valve in an open or closed state. The discharge chamber 76 is in fluidic communication with the outlet 26 and is bounded by the first wear ring assembly 70 and the second wear ring assembly 72. The balancing chamber 78 is bounded by the second wear ring assembly 72 and the thrust-balancing valve in an open or closed state. The vent size adjusts so that a pressure in the balancing chamber 78 balances axial forces on the impeller 18 to minimize any net axial forces on the impeller 18.

Figure 3:
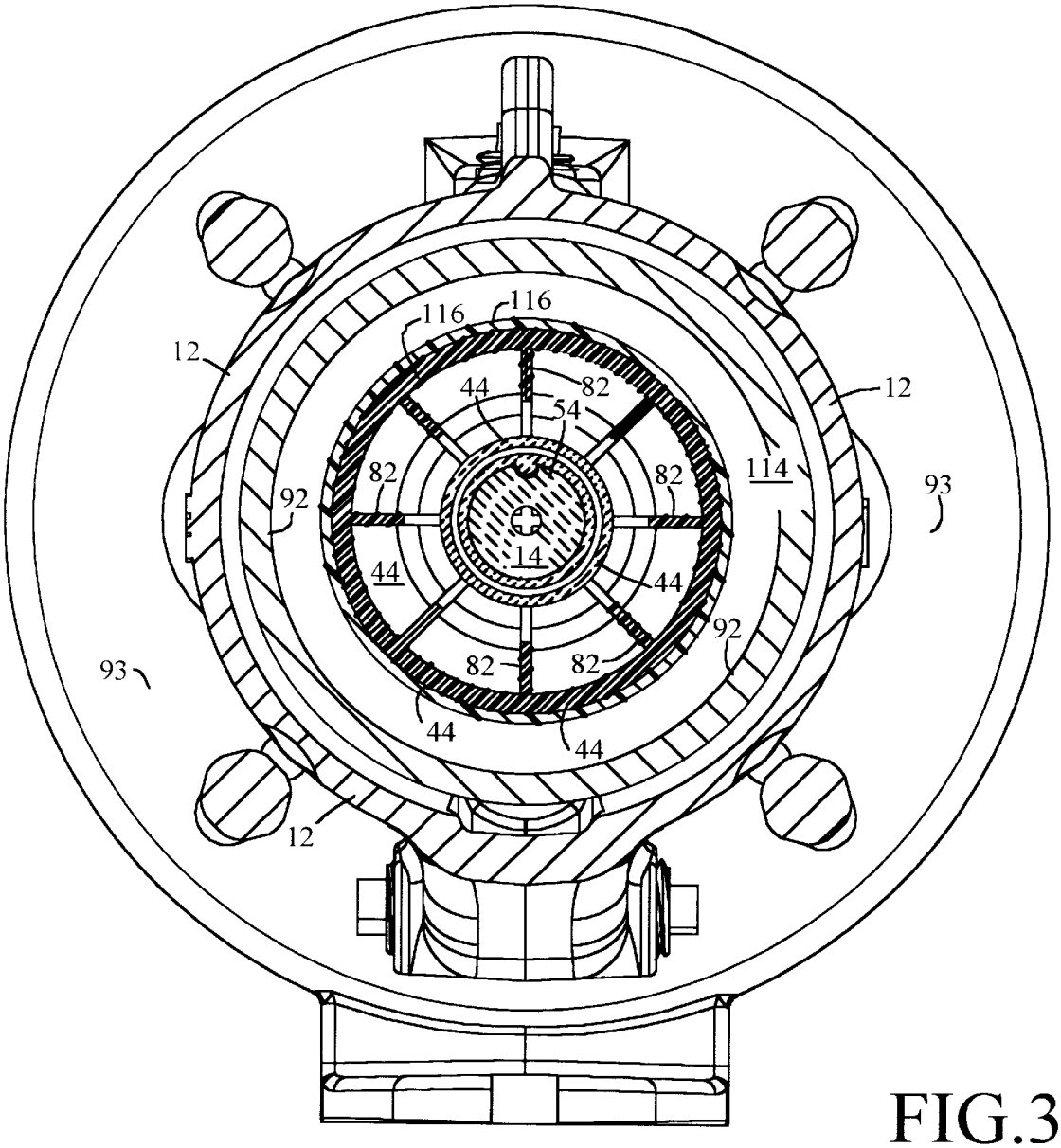
FIG. 3 is a cross-sectional view of the pump as viewed along reference line 3—3 of FIG. 1.

In general, radial ribs (i.e. radial ribs 82) may be placed on any radially extending surface starting inward from an outer radius or circumference of the second inner ring 88. Here, the containment member 44 preferably has radial ribs 82 as shown in FIG. 3. The radial ribs 82 comprise ridges projecting frontward (toward the inlet 24) from an interior of the containment member 44 and extending radially along the interior. The radial ribs 82 do not adversely affect the loading on the auxiliary axial thrust bearing 132 because the axial load balance is preferably maintained during normal operation without frictional contact or with minimal intermittent frictional contact between the auxiliary thrust bearing 132 and a rotating ring (i.e. first inner ring 84) of the first wear ring assembly 70. Thus, the radial ribs 82 prevent centrifuging of particulate matter in the fluid without increasing the load on the pump 10.

The radial ribs 82 cooperate with the thrust balancing valve 20 to enhance the operation of the axial load balancing of the impeller 18 in addition to directing particulate matter outside of the pump 10. The radial ribs 82 increase the uniformity of pressure and the pressure at the valve 20. The increased pressure differential at the thrust balancing valve 20 produces greater stability in axial load balancing. Moreover, the increased pressure contributes toward enhanced lubrication of the radial bearing 16.

Figure 5:
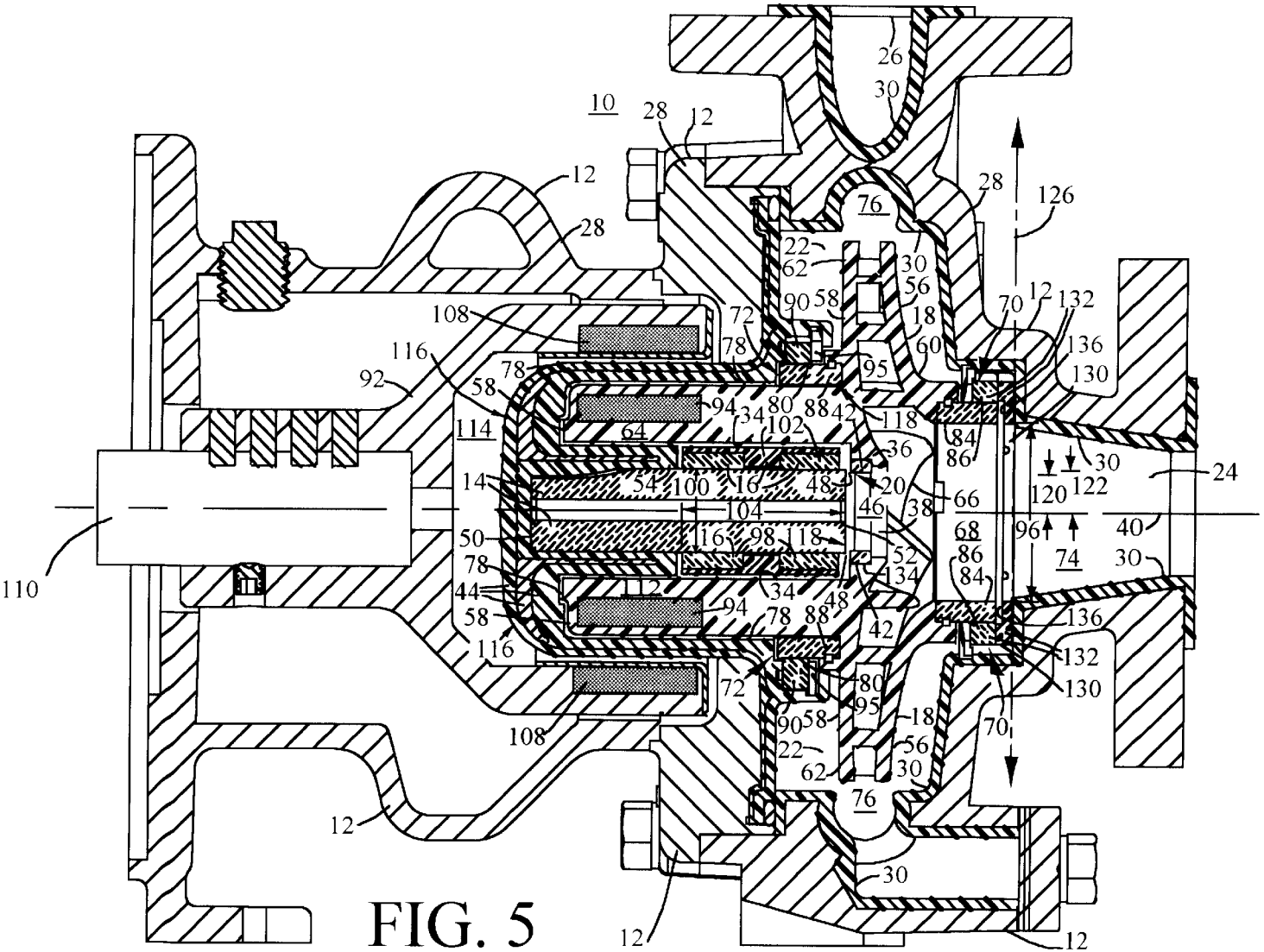
FIG. 5 is a cross-sectional view of a pump of FIG. 1 at a front limit within a range of axial positions of the impeller.

During operation of the pump, the thrust balancing valve 20 is preferably partially open as shown in FIG. 4 to balance axial forces on the impeller 18, or fully open to compensate for axial forces with the auxiliary thrust bearing 132 in an active state as shown in FIG. 5. The impeller 18 moves to an axial position within an axial position range which is stable based on the particular axial load present. The axial load may vary with changes in the pump operating point, changes in the specific gravity of the pumped fluid, the degree of cavitation, and the proportion of entrained gas in the liquid, among other factors.

FIG. 4 illustrates an intermediate axial position 124 of the impeller 18 which lies within a potential range of axial positions between a first limit 126 and a second limit 128. During normal operation of the pump, the axial load balancing system optimally moves the impeller 18 to an intermediate axial position 124, within the range of axial positions, that exactly balances the axial forces upon the impeller 18 so that the net axial forces acting upon the impeller 18 approach or equal zero.

The first limit 126 or forward limit of axial travel for the impeller 18 is defined by contact between the thrust pad 130 and the rotating ring (i.e. first inner ring 84) of the wear first ring assembly 70, as illustrated in FIG. 5. The forward direction of the impeller 18 is toward the inlet 24 of the pump. If the axial thrust is so extreme or so transient that the valve 20 cannot compensate for the axial thrust, an auxiliary axial thrust bearing 132 is formed between a rotating ring of the first wear ring assembly 70 and the thrust pad 130.

The thrust pad 130 is preferably a generally annular member affixed to a pump interior near the inlet 24 within the suction chamber 74 (i.e. first inner ring 84). The thrust pad 130 may have a recess adapted to receive the rotating ring. The thrust pad 130 preferably is composed of a polymer, a fiber-reinforced polymer, a polymer composite, a plastic, a fiber-reinforced plastic, a plastic composite, a ceramic, or a corrosion resistant material. For example, polytetrafluoroethylene may be used to form at least the contact portion 136 of the thrust pad 130 that contacts the rotating ring as described above under unusual pump operating conditions of high axial thrust.

The second limit 128 or backward limit of axial travel for the impeller 18 is defined by contact between the ring 42 and the second end 52 of the shaft 14 associated with the valve 20, as illustrated in FIG. 1. The second limit 128 is not generally reached during normal operation of the pump 10, but may be reached when the pump 10 is turned off or when axial load transients occur. Advantageously, the ring 42 may be removed from the impeller hub 36 to be replaced with another ring having a different thickness so that the second limit 128 of axial travel may be adjusted to suit the operating point and specific gravity of the pumped fluid, among other factors.

In FIG. 4, arrows indicate the direction of primary fluid flow 138 and secondary fluid flow 140 within the pump during normal operation when the impeller 18 is in an intermediate axial position 124. The primary fluid flow 138 enters an inlet 24 of the pump to a suction chamber 74. From the suction chamber 74 the fluid is drawn into the impeller 18 and released into a discharge chamber 76. The primary fluid flow 138 then travels from the discharge chamber 76 to the outlet 26 of the pump.

The secondary fluid flow 140 is lesser in volume than the primary fluid flow 138, but the second fluid flow is critical to the thrust balancing of axial loads on the impeller 18 in accordance with the present invention. First, the secondary fluid flow 140 travels from the discharge chamber 76 through a gap 80 in the second wear ring assembly 72. Second, the secondary fluid flow 140 travels backward in an annular gap between the containment member 44 and the cylindrical portion 64 of the impeller 18 as the impeller 18 rotates. Third, the secondary fluid flow 140 is disrupted and enhanced in pressure and pressure uniformity by radially extending ribs in the interior of the containment member 44. Fourth, the secondary fluid flow 140 is sucked frontward between the impeller recess 34 and radial bearing 16 within the spline-like openings 106. Finally, the secondary fluid flow 140 traverses the vent 20 under the influence of a pressure differential, passes through the opening 38, and returns to the suction chamber 74. The secondary fluid flow 140 is preferably sufficient to expel particulate matter, which was drawn into the secondary fluid flow 140, back into the suction chamber 74. The thrust balancing system 118 comprises a hydraulic system for adjusting the hydrodynamic characteristics of secondary fluid flow 140 path to compensate for fluctuations in axial load and for balancing axial load upon the impeller 18.

Figure 6:
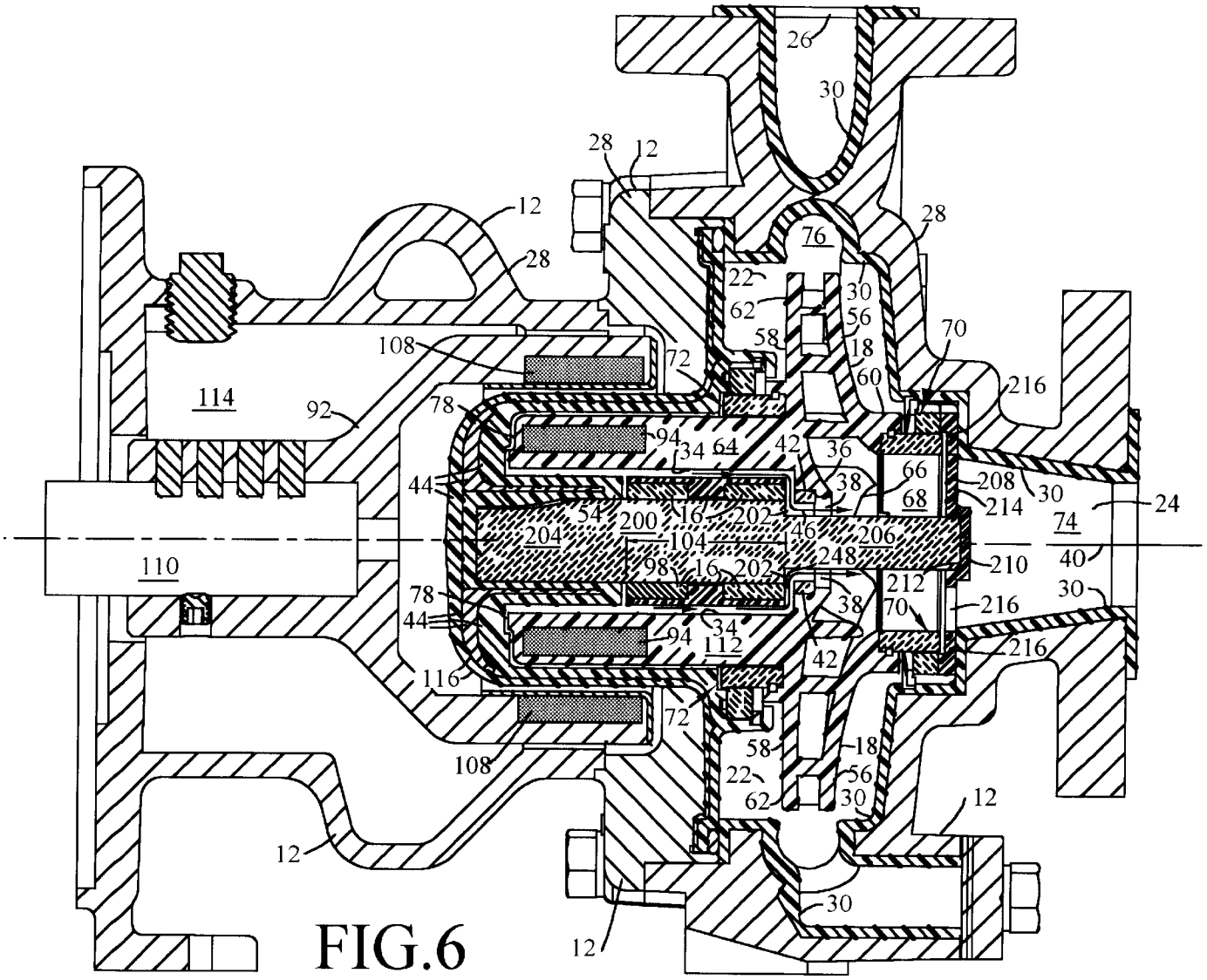
FIG. 6 is a cross-sectional view of an alternate embodiment of a centrifugal magnetic-drive pump in accordance with the invention.

FIG. 6 illustrates an alternate embodiment of the pump that is similar to the embodiment shown in FIG. 1 through FIG. 5, except the shaft 200 and shaft mounting arrangement in FIG. 6 is different. The shaft 200 of FIG. 6 has a step 202 between a first shaft section 204 and a second shaft section 206. The first shaft section 204 has a first diameter greater than a second diameter of the second shaft section 206. Sufficient clearance exists between the second diameter and the ring to form a variable-sized vent 248. The step 202 comprises a shoulder that forms a stop for the ring. The step 202 is preferably orthogonal in a radial cross-section of the shaft, although in alternate embodiments the step 202 is curved in the radial cross-section of the shaft.

The shaft 200 is supported by the containment member 44 and a shaft support 208 member. The shaft support 208 member is located toward the inlet of the pump within the suction chamber. The shaft support 208 generally has a hub 210 with a recess 212 for receiving the shaft 200, spokes 214 extending from the hub 210 to a rim 216. The rim 216 is mechanically attached or press-fitted to the housing. The shaft support 208 is preferably made of a corrosion-resistant material, such as a polymer composite, or the shaft support 208 has a corrosion-resistant coating upon a rigid metal or alloy base.

While a stationary-shaft version of a centrifugal pump is disclosed herein, the general principals of the invention disclosed herein may be applied equally to a centrifugal pump having a rotating shaft. Similarly, while the ring for the thrust balancing valve was depicted as a separate element herein, in alternate embodiments the ring may be formed as an integral collar or an annular protrusion integrated into the impeller or integrally molded as a portion of the impeller. In another alternate embodiment, a disk could be attached to a stepped shaft or a cantilevered shaft to act as the stationary side of the thrust balancing valve.

The foregoing detailed description is provided in sufficient detail to enable one of ordinary skill in the art to make and use the pump having the thrust balancing system. The foregoing detailed description is merely illustrative of several physical embodiments of the pump. Physical variations of the pump, not fully described in the specification, are encompassed within the purview of the claims. Accordingly, the narrow description of the elements in the specification should be used for general guidance rather than to unduly restrict the broader descriptions of the elements in the following claims.

We claim:

1. A centrifugal pump comprising:

a housing having a housing cavity, an inlet, and an outlet;

a shaft located in the housing cavity;

a radial bearing coaxially surrounding said shaft, the shaft and the radial bearing being rotatable with respect to one another;

an impeller positioned to receive a fluid from the inlet and to exhaust a fluid to the outlet, the impeller having an impeller recess terminating at an impeller hub with an opening therein, the impeller recess receiving the radial bearing;

a thrust balancing valve including a ring extending from the impeller hub, the ring having an interior region in spatial or fluidic communication with the opening, the ring and the shaft adapted to define a variable-sized vent between the ring and the shaft.

2. The pump according to claim 1 wherein the variable-sized vent adjusts to a vent size for regulating a flow of fluid through the variable-sized vent to balance net axial forces acting upon the impeller during operation of the pump.

3. The pump according to claim 1 wherein the impeller has a front side and a back side; and further comprising a first wear ring assembly associated with the front side and a second wear ring assembly associated with a back side, the first wear ring assembly defining a boundary between a suction chamber and a discharge chamber and the second wear ring assembly defining a boundary between the discharge chamber and a balancing chamber, the second wear ring assembly arranged to reduce a discharge pressure of fluid toward a balancing pressure.

4. The pump according to claim 3 wherein the balancing pressure is within a range from approximately one-quarter of the total dynamic head of the discharge chamber to approximately one-third of the total dynamic head of the discharge chamber.

5. The pump according to claim 1 further comprising a containment member for containing the fluid, and wherein the shaft has a first end and a second end, the first end mating with the containment member and the second end forming a generally planar boundary of the variable size vent and a stop for stopping rearward axial movement of the impeller.

6. The pump according to claim 5 wherein the shaft is generally hollow and slidably removable from the containment member.

7. The pump according to claim 1 wherein the impeller has a front side and a back side; and further comprising a first wear ring assembly associated with the front side and a second wear ring assembly associated with the back side, the first wear ring assembly including a first outer ring resiliently biased axially frontward, generally toward the inlet, and the second wear ring assembly including a second outer ring axially biased axially backwards; the radial bearing being aligned to primarily support radial loads associated with operating the pump.

8. The pump according to claim 1 wherein the impeller has an impeller inlet diameter and wherein the radial bearing has a bearing diameter less than the impeller inlet diameter, the bearing diameter representing a diameter at an interface between a rotational state of the radial bearing and a stationary state of the shaft.

9. The pump according to claim 1 wherein the impeller has a front side and a back side; and further comprising a first wear ring assembly associated with the front side and a second wear ring assembly associated with a back side, the first wear ring assembly including a first outer ring cooperating with a first inner ring on the impeller, the first inner ring being elongated to have a greater axial length than the first outer ring, the first wear ring assembly allowing operation of the impeller within a range of potential axial positions of the impeller relative to the housing; the second wear ring assembly including a second outer ring cooperating with a second inner ring on the impeller, the second inner ring being elongated to have a greater axial length than the second outer ring, the second wear ring assembly allowing operation of the impeller within the range of potential axial positions of the impeller relative to the housing.

10. The pump according to claim 9 wherein the thrust balancing valve adjusts flow of the fluid to hydraulically displace the impeller to an axial position within the range that minimizes any net axial force on the impeller.

11. The pump according to claim 1 further comprising:

a first inner ring associated with a front side of the impeller, the first inner ring bounding a first generally circular area;

a second inner ring associated with back side of the impeller, the second inner ring bounding a second generally circular area, the first generally circular area being less than or equal to seventy percent of the second generally circular area to promote a balancing force for balancing net axial forces acting upon the impeller during operation of the pump.

12. The pump according to claim 1 wherein the radial bearing comprises a carbon bushing coextensively aligned with a center of gravity of the impeller, the radial bearing having a diameter minimized to an extent to permit dry-running of the pump for a continuous period of at least one half hour.

13. The pump according to claim 1 wherein the radial bearing comprises a ceramic member coextensively aligned with a center of gravity of the impeller, the radial bearing having a diameter minimized to an extent to permit dry-running of the pump for a continuous period of at least five minutes.

14. The pump according to claim 1 wherein the shaft has a step between a first shaft section and a second shaft section, the first shaft section having a first diameter greater than a second diameter of the second shaft section, and wherein sufficient clearance exists between the second diameter and the ring to form the variable-sized vent.

15. The pump according to claim 14 wherein the step forms a stop for the ring.

16. A magnetic-drive centrifugal pump comprising:

a housing having a housing cavity, an inlet, and an outlet;

a shaft located in the housing cavity;

a radial bearing coaxially surrounding said shaft, the shaft and the radial bearing being rotatable with respect to one another;

an impeller positioned to receive a fluid from the inlet and to exhaust a fluid to the outlet, the impeller having an impeller recess terminating at an impeller hub with an opening therein, the impeller recess receiving the radial bearing;

a thrust balancing valve including a ring projecting from the impeller hub, the ring having an interior region in fluidic communication with the opening, the ring and the shaft adapted to define a variable-sized vent between the ring and the shaft;

a first magnet assembly associated with the impeller such that the first magnet assembly and the impeller rotate simultaneously;

a second magnet assembly coaxially oriented with respect to the first magnet assembly, the second magnet assembly permitting coupling to a drive shaft;

a containment member oriented between the first magnet assembly and the second magnet assembly.

17. The pump according to claim 16 wherein the variable-sized vent adjusts to a vent size for regulating a flow of fluid through the variable-sized vent to balance net axial forces acting upon the impeller during operation of the pump.

18. The pump according to claim 16 wherein the impeller has a front side and a back side; and further comprising a first wear ring assembly associated with the front side and a second wear ring assembly associated with a back side, the first wear ring assembly defining a boundary between a suction chamber and a discharge chamber and the second wear ring assembly defining a boundary between the discharge chamber and a balancing chamber, the second wear ring assembly arranged to reduce a discharge pressure of fluid toward a balancing pressure.

19. The pump according to claim 18 wherein the balancing pressure is within a range from approximately one-quarter of the total dynamic head of the discharge chamber to approximately one-third of the total dynamic head of the discharge chamber.

20. The pump according to claim 16 wherein the shaft has a first end and a second end, the first end mating with the containment member and the second end forming a boundary of the variable size vent and a stop for stopping rearward axial movement of the impeller.

21. The pump according to claim 20 wherein the shaft is generally hollow and slidably removable from the containment member.

22. The pump according to claim 16 wherein the impeller has a front side and a back side; and further comprising a first wear ring assembly associated with the front side and a second wear ring assembly associated with a back side, the first wear ring assembly including a first outer ring resiliently biased axially frontward, generally toward the inlet, and the second wear ring assembly including a second outer ring resiliently biased axially backwards; the radial bearing being aligned to primarily support radial loads associated with operating the pump.

23. The pump according to claim 16 wherein the impeller has an impeller inlet diameter and wherein the radial bearing has a bearing diameter less than the impeller inlet diameter, the bearing diameter representing a diameter at an interface between a rotational state of the radial bearing and a stationary state of the shaft.

24. The pump according to claim 16 wherein the impeller has a front side and a back side; and further comprising a first wear ring assembly associated with the front side and a second wear ring assembly associated with a back side, the first wear ring assembly including a first outer ring cooperating with a first inner ring on the impeller, the first inner ring having a greater axial length than the first outer ring, the first wear ring assembly allowing operation of the impeller within a range of potential axial positions of the impeller relative to the housing, the second wear ring assembly including a second outer ring cooperating with a second inner ring on the impeller, the second inner ring having a greater axial length than the second outer ring, the second wear ring assembly allowing operation of the impeller within a range of potential axial positions of the impeller relative to the housing.

25. The pump according to claim 24 wherein the thrust balancing valve adjusts flow to hydraulically displace the impeller to an axial position within the range that minimizes any net axial force on the impeller.

26. The pump according to claim 16 further comprising:

a first inner ring associated with a front side of the impeller, the first inner ring bounding a first generally circular area;

a second inner ring associated with back side of the impeller, the second inner ring bounding a second generally circular area, the first generally circular area being less than or equal to seventy percent of the second generally circular area to promote a balancing force for balancing net axial forces acting upon the impeller during operation of the pump.

27. The pump according to claim 16 wherein the radial bearing comprises a carbon bushing coextensively aligned with a center of gravity of the impeller, the radial bearing having a diameter minimized to an extent to permit dry-running of the pump for a continuous period of at least one half hour.

28. The pump according to claim 16 wherein the radial bearing comprises a ceramic member coextensively aligned with a center of gravity of the impeller, the radial bearing having a diameter minimized to an extent to permit dry-running of the pump for a continuous period of at least five minutes.

29. The pump according to claim 16 wherein the shaft has a step between a first shaft section and a second shaft section, the first shaft section having a first diameter greater than a second diameter of the second shaft section, and wherein sufficient clearance exists between the second diameter and the ring to form the variable-sized vent.

30. The pump according to claim 29 wherein the step forms a stop for the ring.

31. The pump according to claim 16 wherein the containment member includes an interior having radially extending ribs for increasing a pressure and pressure uniformity of the fluid in a balancing chamber bounded by the thrust balancing valve to enhance the stability of balancing axial loads upon the impeller.

* * * * *